US007903988B2

(12) United States Patent
Ozaki et al.

(10) Patent No.: US 7,903,988 B2
(45) Date of Patent: Mar. 8, 2011

(54) IMAGE FORMING APPARATUS CAPABLE OF DETECTING GHOST IMAGE

(75) Inventors: Yoshifumi Ozaki, Kanagawa (JP); Shinichiro Fujimori, Kanagawa (JP); Takashi Ochi, Kanagawa (JP); Akihiko Noda, Kanagawa (JP); Shinichi Kuramoto, Kanagawa (JP); Kenji Ogi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 21 days.

(21) Appl. No.: 12/464,460

(22) Filed: May 12, 2009

(65) Prior Publication Data

US 2010/0142983 A1 Jun. 10, 2010

(30) Foreign Application Priority Data

Dec. 8, 2008 (JP) ..... 2008-312052

(51) Int. Cl.
*G03G 15/00* (2006.01)

(52) U.S. Cl. ..... 399/49; 399/72

(58) Field of Classification Search ..... 399/46, 399/49, 50, 51, 53, 55, 66, 72
See application file for complete search history.

(56) References Cited

U.S. PATENT DOCUMENTS

| | | | | |
|---|---|---|---|---|
| 5,559,587 | A | 9/1996 | Ogata et al. | |
| 7,292,798 | B2 * | 11/2007 | Furukawa et al. | 399/49 |
| 2005/0249515 | A1 | 11/2005 | Furukawa et al. | |
| 2006/0203066 | A1 | 9/2006 | Matsuyama | |

FOREIGN PATENT DOCUMENTS

| | | |
|---|---|---|
| JP | 7-36231 | 2/1995 |
| JP | 7-140734 | 6/1995 |
| JP | 2002-258614 | 9/2002 |
| JP | 2006-106069 | 4/2006 |
| JP | 2006-251070 | 9/2006 |

* cited by examiner

*Primary Examiner* — Hoang Ngo
(74) *Attorney, Agent, or Firm* — Morgan, Lewis & Bockius LLP

(57) ABSTRACT

There is provided an image forming apparatus. The image forming apparatus, after controlling so as to develop the developer image representing the predetermined image formed a plurality of times in the same location on an image carrier by an exposing component, controls such that without performing exposure with the exposing component, the developer image, developed on the image carrier by the developing component applying a biasing voltage to the developer so as to adhere the developer to the image carrier including to the same location on the image carrier, is transferred to the transfer component and detects whether or not a ghost image is generated by comparing the density detected by a detecting component at a position of a transfer body corresponding to the same location of the image carrier to a reference density.

7 Claims, 13 Drawing Sheets

IMAGE FORMING APPARATUS CAPABLE OF DETECTING GHOST IMAGE

CROSS-REFERENCE TO RELATED APPLICATION

This application is based on and claims priority under 35 USC 119 from Japanese Patent Application No. 2008-312052 filed Dec. 8, 2008.

BACKGROUND

1. Technical Field

The present invention relates to an image forming apparatus.

2. Related Art

Due to environmental considerations, EA (emulsion aggregation) toners using a wet production method are being used as toners in recent image forming apparatuses, enabling a reduction in the fixing temperature thereof. In order to achieve an even greater reduction in the fixing temperature crystalline binder polymers are gradually being introduced.

It is known that EA toners have poor cleaning characteristics in comparison to pulverized toners, and that crystalline binder polymers have poor charging characteristics. Consequently, there is a tendency to include a greater proportion of external additives in EA toners, in comparison to pulverized toners, in order to adjust the level of charge and maintain adequate cleaning.

Among such additives, in particular external additives of about 100 nm that are comparatively shaped with angular portions removed therefrom are used as transfer agents, in order to improve developability. However, such external additives readily pass beneath cleaning blades, though toner particles do not pass beneath the cleaning blade, so there is a tendency for external additive filming to occur. Therefore, recent toners are in a state susceptible to problems due to external additive filming due to becoming external-additive-rich.

A particular example of a problem caused by external additive filming is ghost images (ghosting). Within categories of ghosting there is known ghosting caused by localized changes in sensitivity and known ghosting caused by latent image electrical potential due to changes in Rp (residual potential), and also known ghosting caused by the surface condition of a photoreceptor.

SUMMARY OF THE INVENTION

According to an aspect of the invention, there is provided an image forming apparatus. The image forming apparatus includes: an image carrier; a charging component that charges the image carrier to a predetermined electrical potential; an exposing component that exposes the image carrier charged by the charging component with light and forms an electrostatic latent image on the image carrier; a developing component that develops the electrostatic latent image formed on the image carrier by the exposing component, using a developer in a state a biasing voltage is applied, the developer comprising a colorant and an external additive; a transfer body that transfers the developer image developed on the image carrier by the developing component onto a transfer body; a detecting component that detects a density of the developer image transferred onto the transfer body by the transfer body; a removing component that removes residual developer on the image carrier after the developer image has been transferred onto the transfer body by the transfer body; a first control component that controls the charging component, the exposing component, and the developing component such that a developer image representing a predetermined image is transferred onto the transfer body; a second control component that, after the first control component has controlled so as to develop the developer image representing the predetermined image formed a plurality of times in the same location on the image carrier by the exposing component, controls such that without performing exposure with the exposing component, the developer image, developed on the image carrier by the developing component applying a biasing voltage to the developer so as to adhere the developer to the image carrier including to the same location on the image carrier, is transferred to the transfer body; and a ghost image generation detecting component that detects whether or not a ghost image is generated by, after control by the second control component, comparing the density detected by the detecting component at a position of the transfer body corresponding to the same location of the image carrier to a reference density.

BRIEF DESCRIPTION OF THE DRAWINGS

Exemplary embodiments of the present invention will be described in detail based on the following figures, wherein.

DETAILED DESCRIPTION

Explanation will now be given of details of an exemplary embodiment of the present invention, with reference to the drawings. Note that the developer in the exemplary embodiment of the present invention uses a toner (EA toner etc.) including an external additive that is easy to scrape through a cleaning unit, described later, developer is sometimes referred to below simply as "toner".

Figure 1:
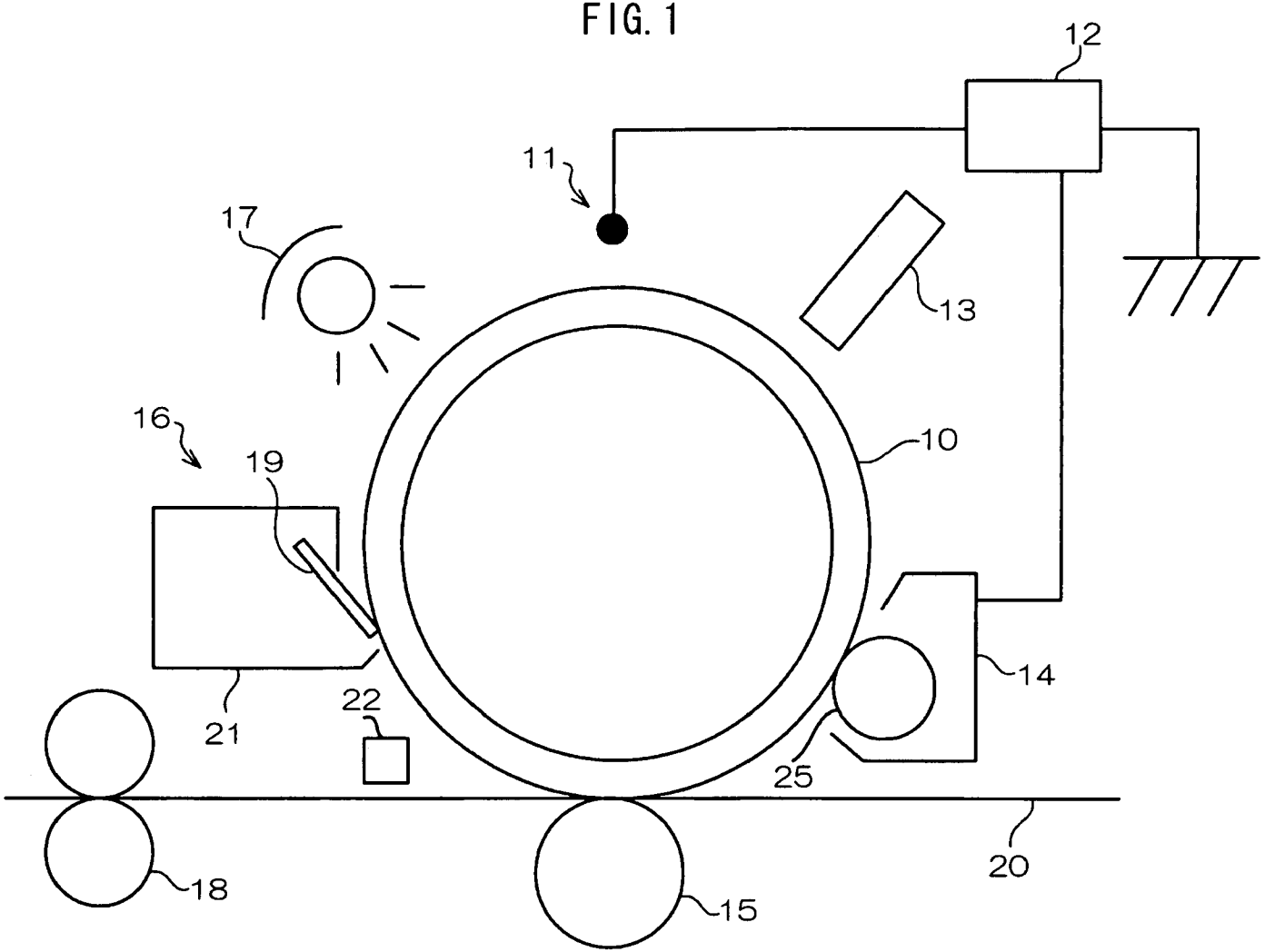
FIG. 1 is a schematic cross-section showing an example of an image forming apparatus.

A explanation will now be given of details of an image forming apparatus according to the present exemplary embodiment, with reference to the drawings. FIG. 1 is a schematic cross-section showing an example of an image forming apparatus. The image forming apparatus shown in FIG. 1 includes: a photoreceptor (image carrier) 10; a charging unit (charging component) 11 that charges the photoreceptor 10 to a predetermined electrical potential; a light-exposing unit (exposing component) 13 that exposes the photoreceptor 10 that has been charged by the charging unit 11 with light to form a latent electrostatic image on the photoreceptor 10; a developing unit (developing component) 14 that develops the latent electrostatic image formed on the photoreceptor 10 by the light-exposing unit 13 using a developer, containing a colorant and an external additive, in a state applied with a biasing voltage; a transfer unit (transfer component) 15 that transfers the developer image that has been developed by the developing unit 14 onto a transfer body 20; a density detection unit (detection component) 22 that detects the density of an image portion of the developer image transferred onto the transfer body 20 by the transfer unit 15, and detects a non-image portion thereof, and a cleaning unit (removing component) 16 that removes any residual developer on the photoreceptor 10 after the developer image has been transferred onto the transfer body 20 by the transfer unit 15.

Also included in the image forming apparatus are a static eliminator 17 that removes residual electrical potential on the surface of the photoreceptor 10, and a fixing unit 18 that fixes the toner image transferred onto the surface of the transfer body 20 by application of heat and/or pressure.

The non-contact charging unit 11, such as a charging roller, is disposed above the photoreceptor 10 shown in FIG. 1, and the charging unit 11 is operated by a voltage supplied from a power source 12. A non-contact charging unit is used for the charging unit 11 in the current embodiment, however, both contact charging methods and non-contact charging methods may be used in the present invention. The developing unit 14 is also operated by voltage supplied from the power source 12, and applies an electrical potential to the toner using the supplied voltage.

The cleaning unit 16 is configured with a blade 19, serving as the cleaning blade of the present invention, disposed at an opening of a box 21, with the cleaning unit 16 constructed such that residual toner and the like removed from the surface of the photoreceptor 10 is collected within the box 21.

There are no particular limitations in the present invention to other elements of the configuration, the light-exposing unit 13, developing unit 14, transfer unit 15, static eliminator 17 and fixing unit 18, and these can be configured by application unmodified of known technology in the electrophotographic field.

The photoreceptor 10 is also of a circular cylindrical shape, being a rotating body rotating about a central axis connecting the centers of the circles at both ends of the circular cylinder. The developing unit 14 develops by rotating a developing rotating body 25, to which developer is adhered, about an axis substantially parallel to the axis of the photoreceptor 10, rotating at a specific rotational speed so as to slide the developing rotating body 25 with friction against the photoreceptor 10. Control is possible such that the developing rotating body 25 can be rotated at various rotational speeds.

Explanation will now be given of an image forming method of the present invention, using the image forming apparatus of FIG. 1. The surface of the photoreceptor 10 is uniformly charged by the charging unit 11, and a latent image is formed by the light-exposing unit 13 (latent image forming process). The latent image formed on the surface of the photoreceptor 10 is developed with toner housed within the developing unit 14, so as to form a toner image (developing process). The toner image formed on the surface of the photoreceptor 10 is transferred onto the surface of the transfer body 20 passing between the photoreceptor 10 and the facing transfer unit 15 (transfer process), and is then furthermore fixed by application of heat and/or pressure etc. of the fixing unit 18.

Any residual toner on the surface of the photoreceptor 10 after transfer, however, is removed by the cleaning unit 16 equipped with the blade 19 (cleaning process). Before continuing with the next image forming cycle, any residual electrical potential on the surface of the photoreceptor 10 is removed by the static eliminator 17.

Figure 2:
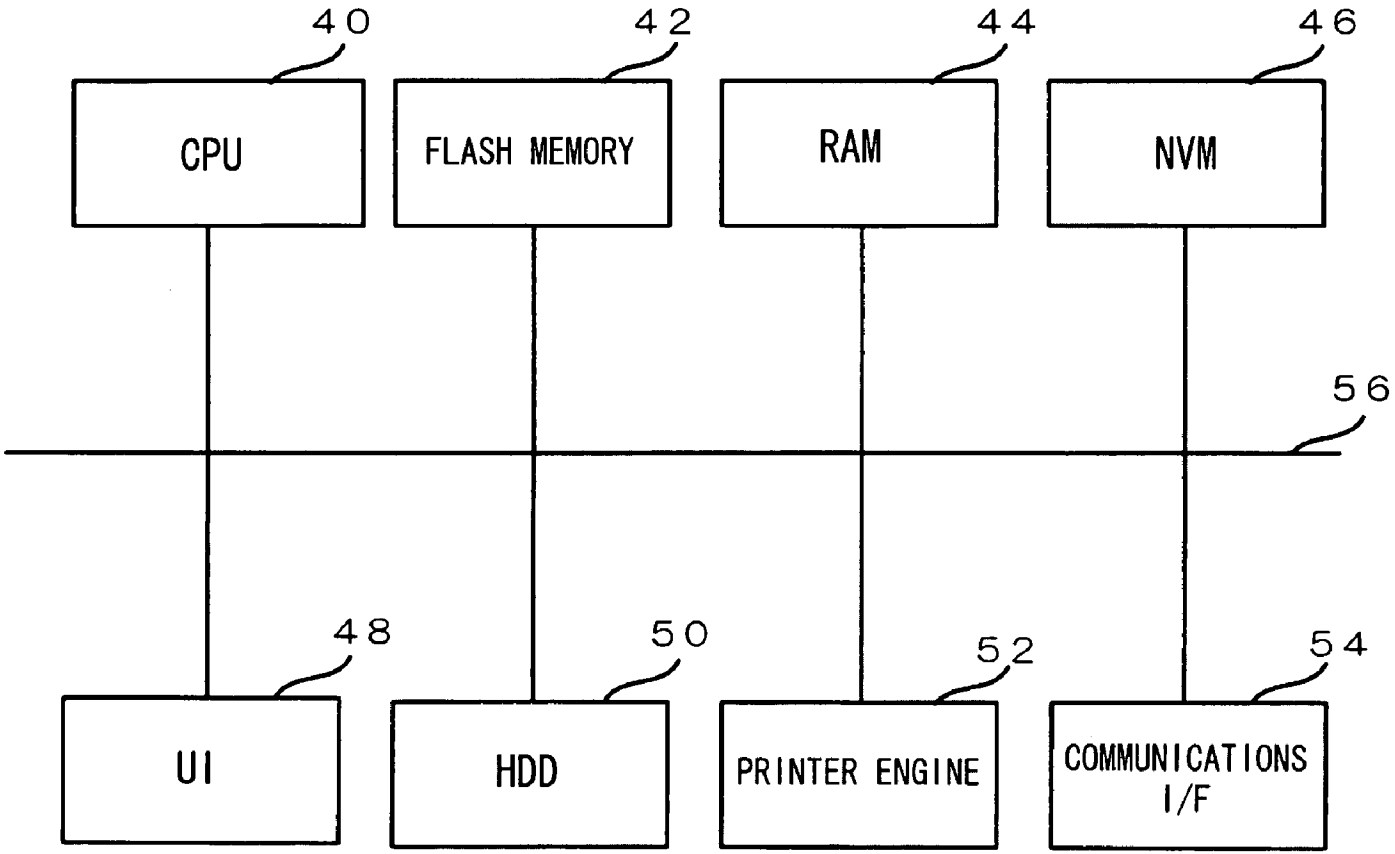
FIG. 2 is a drawing showing an electrical configuration of an image forming apparatus.

Explanation will now be given of an electrical configuration of the image forming apparatus, with reference to FIG. 2. The image forming apparatus includes a CPU (Central Processing Unit) 40, a flash memory 42, a RAM (Random Access Memory) 44, a NVM (Non-Volatile Memory) 46, a UI (User Interface) 48, a HDD (Hard Disk Drive) 50, a communications I/F (Interface) 54 and a bus 56.

The CPU 40 controls the overall operation of the image forming apparatus, and the processing shown in a later described flow chart is executed by the CPU 40. A program expanded in the RAM 44, and a boot program for operating at start up, etc. are stored on the flash memory 42.

The RAM 44 is a storage device in which an OS (Operating System), program, and image data are expanded. Setting values related to the image forming apparatus and the like are stored on the NVM 46.

For connecting to a network the communications I/F 54 is configured with a NIC (Network Interface Card), and the driver thereof, or with a USB device etc.

A printer engine 52 is an engine for forming an image on a recording medium, such as paper, and includes the configuration shown in FIG. 1. The HDD 50 is a storage device for storing image data and the like. The UI 48 is used when a user operates the image forming apparatus and for inputting data. The bus 56 is used when data is being exchanged.

In addition to the configuration described above, for example, a scanner, an interface for connecting to a telephone line, and units relating to image processing may also be included.

Explanation will be given below of processing according to the present exemplary embodiment, based on the above configuration. In the present exemplary embodiment, a test image is formed as a latent image on the surface of the photoreceptor, and the portions of the latent image due to the test image are called image portions, and portions thereof other than these are called non-image portions. Also the portions of the transfer body 20 to which the test image is transferred are called the image portions, and portions thereof other than these are called non-image portions.

Figure 3:
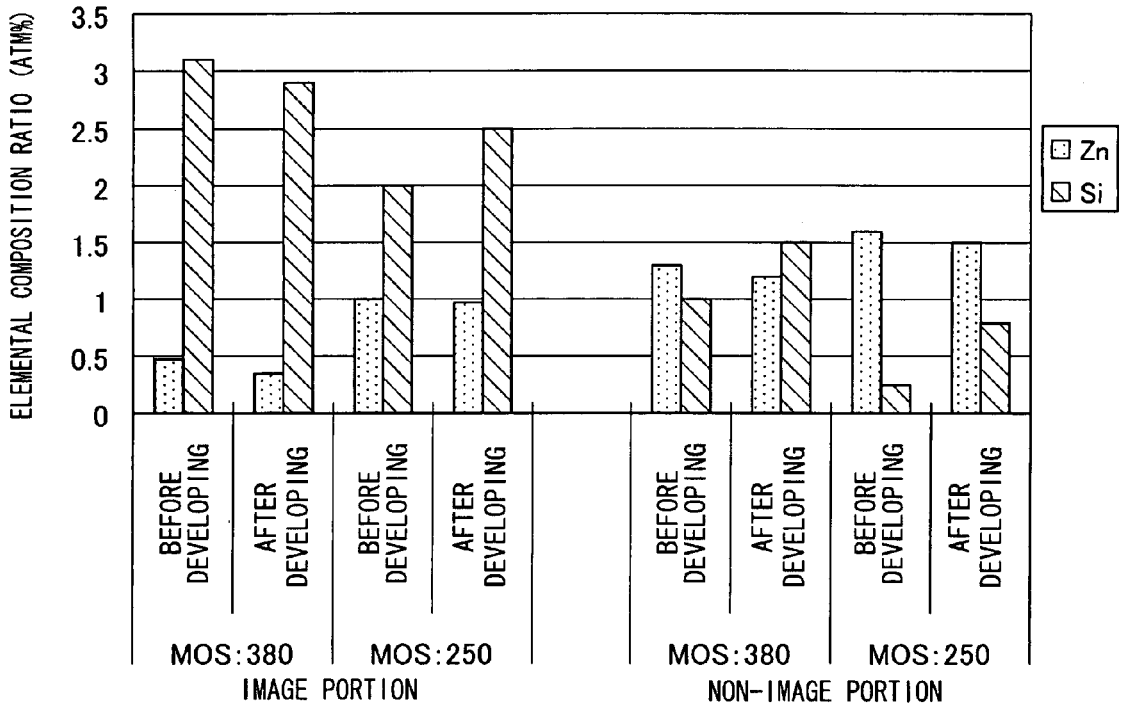
FIG. 3 is a graph showing elemental composition ratios on the surface of a photoreceptor.

In the present exemplary embodiment an external additive that readily passes under the blade 19 is used, however, the reason for passing under is shown in FIG. 3.

The horizontal axis of the graph shown in FIG. 3 shows image portions and non-image portions before developing and after developing, and MOS (the amount of toner per unit surface area of the photoreceptor) is also shown before developing and after developing. The vertical axis shows elemental composition ratios. The elements are Zn and Si.

The graph shown in FIG. 3 therefore shows the elemental composition ratios of image portions and non-image portions before developing and after developing, and is also a graph showing differences in the elemental composition ratio before developing and after developing due to different MOS.

As shown in FIG. 3, supply of ZnSt (zinc stearate) mainly occurs to the non-image portions. Conditions arise at the image portions in which external additive can readily pass under the blade 19, due to supply of ZnSt being low, reducing the amount of ZnSt.

Consequently, when development is performed plural times in succession at the same position on the photoreceptor, depending on a combination of environmental factors, developing conditions and amount used on the photoreceptor, even at a position after passing the blade 19 the external additive may have passed under the blade 19, causing filming.

A process by which this filming generates ghosting will now be explained, with reference to FIGS. 4A to 4E. These figures show graphs and states of external additive and toner on the surface of a photoreceptor. The graphs above and diagrams showing the surface of the photoreceptor below correspond to each other. The horizontal axis of each graph indicates corresponding positions on the photoreceptor surface, and the vertical axis indicates the electrical potential. The black circles indicate external additive, and the white circles indicate toner.

Note that in the present exemplary embodiment, the photoreceptor surface and the toner are negatively charged. Therefore the vertical axis of the graphs shown in these figures shows the magnitude of the negative charge.

Figures 4A, 4B, 4C, 4D, 4E:
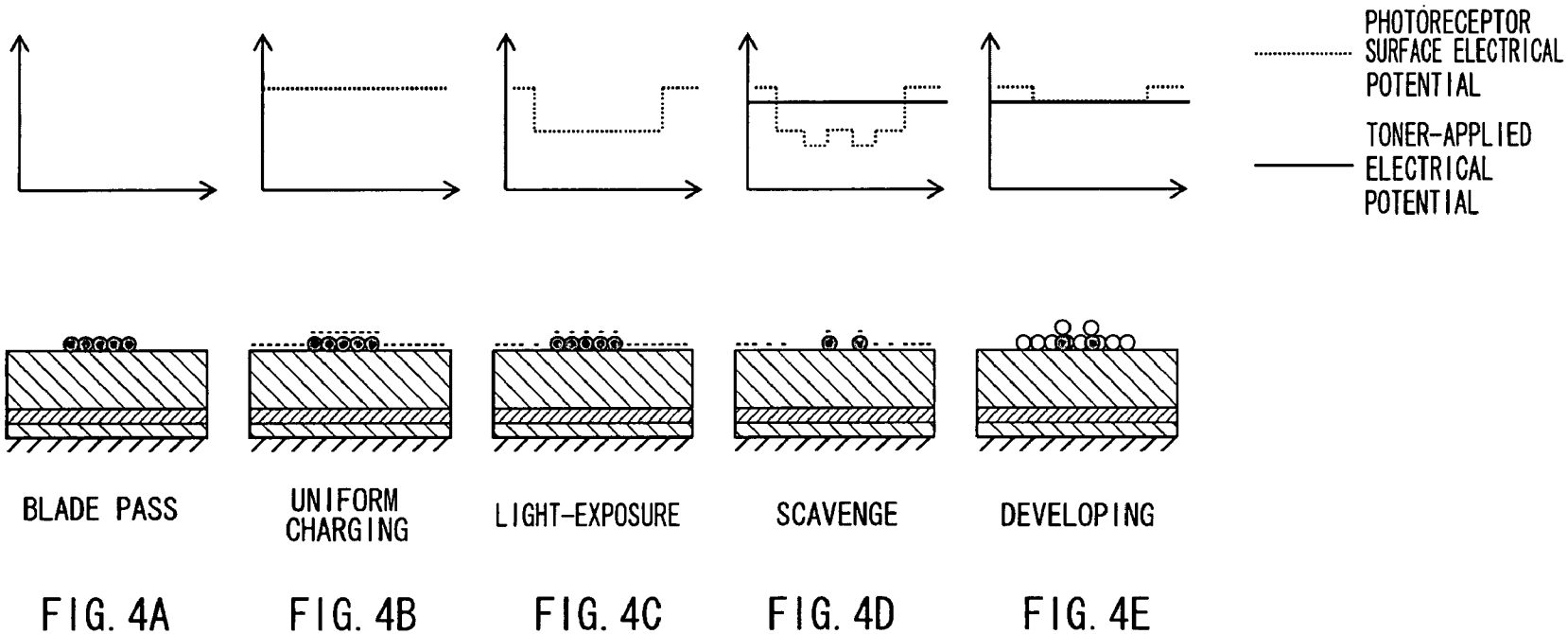
FIGS. 4A to 4E are diagrams showing a process that generates a ghost image due to filming.

First, FIG. 4A shows a state of the external additive on the photoreceptor surface after passing under the blade 19. In this manner, where an image is formed repeatedly on the same portion the supply of ZnSt is low, and in particular under conditions of high sliding friction, due to high MOS and the peripheral speed ratio of the photoreceptor 10 to the developing unit 14, a layer where external additive has passed under the blade 19 is formed at the image portion where the blade 19 has not been able to scrape off the ZnSt or to stop external additive from passing underneath.

In the next FIG. 4B, a state is shown in which the photoreceptor surface is uniformly charged by the charging unit 11. FIG. 4C shows a state in which a portion corresponding to the image portion has been light-exposed by the light-exposing unit 13.

As shown in FIG. 4D, the negatively charged external additive layer that has passed beneath the blade is partly removed in the developing unit 14, and since the electrical potential is lowered at the removed portion, the surface electrical potential is reduced in comparison to where there is no passed external additive. The amount of developer increases, as shown in FIG. 4E, due to an increase in the difference between the electrical potential applied to the toner and the electrical potential of the image portion.

Figure 5:
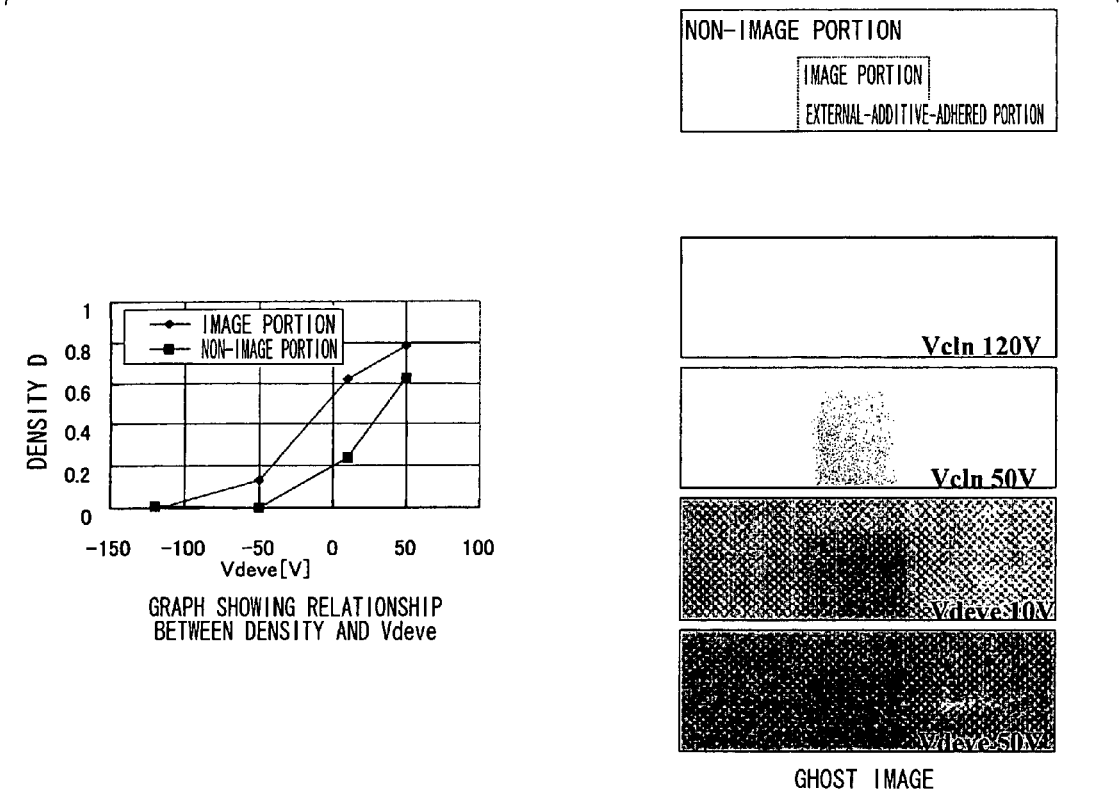
FIG. 5 is a drawing showing actual ghost images.

Actual ghost images generated in this manner are shown in FIG. 5. FIG. 5 is a graph showing the relationship between density D and Vdeve, and ghost images. The Vdeve shown in FIG. 5 shows the difference in electrical potential between the electrical potential charging the image portion and the electrical potential applied to the toner, Vcln shows the difference in electrical potential between the electrical potential applied to the toner and the electrical potential charging the non-image portion.

It can be seen from the graph in FIG. 5 that the density difference is greatest between the image portion and the non-image portion when the Vdeve is in the vicinity of 10V.

In the four images surrounding the ghost image shown as a rectangle, the image portion thereof is in the vicinity of the central bottom portion, with the remaining portions being a non-image portion, as shown in the diagram above. As shown in FIG. 5, an image starts to be visible when Vcln of the image portion is about 50V, and a dense-feint contrast can be clearly ascertained when the above described Vdeve is in the vicinity of 10V. When the Vdeve reaches 50V, the density difference between the image portion and the non-image portion decreases and all over becomes dense.

Figure 6:
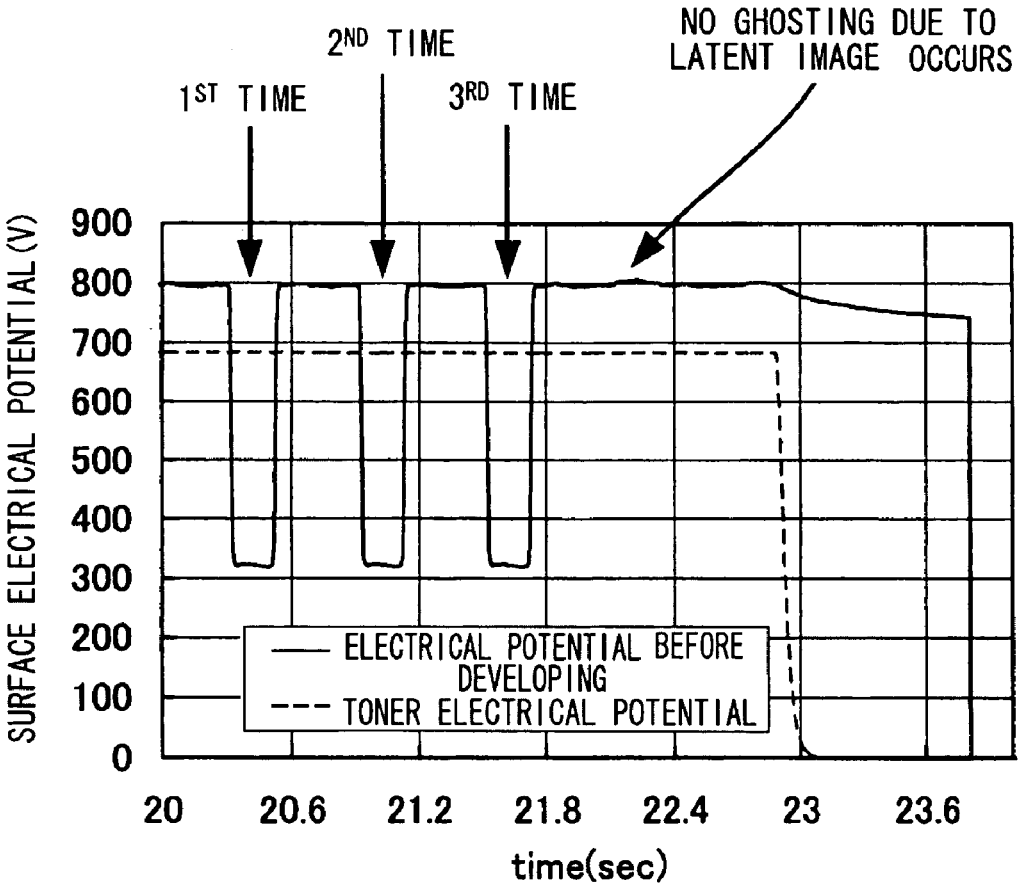
FIG. 6 is a graph showing where a ghost image due to a latent image does not occur.

By use of FIG. 6 it can be shown that the ghost image generated in the above described manner is not a latent image-caused ghost image, caused by a factor other than the external additive.

FIG. 6 is a graph showing the passage of time on the horizontal axis and the electrical potential of the photoreceptor surface on the vertical axis. The graphs show that, after 30 times of forming a latent image of the test image, the photoreceptor surface electrical potential is set before developing such that a latent image is not formed. However, as shown by the arrow, after setting the photoreceptor surface electrical potential so as not to form a latent image there is no reduction in the surface electrical potential before developing, and so it is clear that the ghost image is not one caused by a latent image.

A process for detecting the generation of an above described ghost image caused by external additive will now be explained. This process is a process executed by control of the CPU 40.

First, in step 101, the charging unit 11 uniformly charges the surface of the photoreceptor 10. Next, in step 102, the light-exposing unit 13 light-exposes a latent image of the test image. Next, in step 103, the developing unit 14 develops by applying biasing voltage A normally used when image forming. Then, at step 104, the transfer unit 15 transfers the image onto the surface of the transfer body 20, the above described external additive passing occurs with residual toner not being removed by the blade 19, however the static eliminator 17 removes the residual electrical potential on the surface of the photoreceptor 10.

Determination is made at step 105 as to whether or not the above described process has been performed a predetermined number of times (a minimum of two times), and if this determination is negative then the process returns to step 101. The processing of above described step 101 to step 105 is processing to develop a plural number of times a developer image representing the test image formed by the light-exposing unit 13 in the same location on the photoreceptor 10.

However, when the determination at step 105 is affirmative, then at step 106 the charging unit 11 uniformly charges the surface of the photoreceptor 10. Then at step 107, without forming a latent image, developing with toner is performed by application of a biasing voltage B, different from the biasing voltage A, and at step 108 the image is transferred onto the transfer body 20 by the transfer unit 15. The relationship between the biasing voltage A and the biasing voltage B will be explained later.

The processing of step 106 to step 108 is processing to control such that, with no light-exposure being performed by the light-exposing unit 13, a developer image is developed on the photoreceptor 10 by the developing unit 14 applying a biasing voltage to adhere developer to the photoreceptor 10, including the same location on the photoreceptor 10 as that of the test image, and the developed image on the photoreceptor 10 is transferred by the transfer unit 15.

At the next step 109, the density detection unit 22 detects a density X of toner at a position corresponding to an image portion on the surface of the transfer body 20 (a location at which the test image was formed ("the same location")), and detects a density Y of toner at a position corresponding to a non-image portion on the surface of the transfer body 20 (a location different for the same location: more particularly a location not formed with the test image in the vicinity of where the test image was formed).

Then at step 110, the densities detected by the density detection unit 22 for each of the image portion and the non-image portion are compared with each other. More specifically, a state in which ghost images are generated due to external additive is detected is made at the next step 111 when determination that the difference between the density X and the density Y is greater than a predetermined value Z. At step 112 a state in which a ghost image due to external additive is not generated is detected when the determination is negative at step 110, and the processing is ended. Z is a value predetermined based on test results etc.

Figure 8:
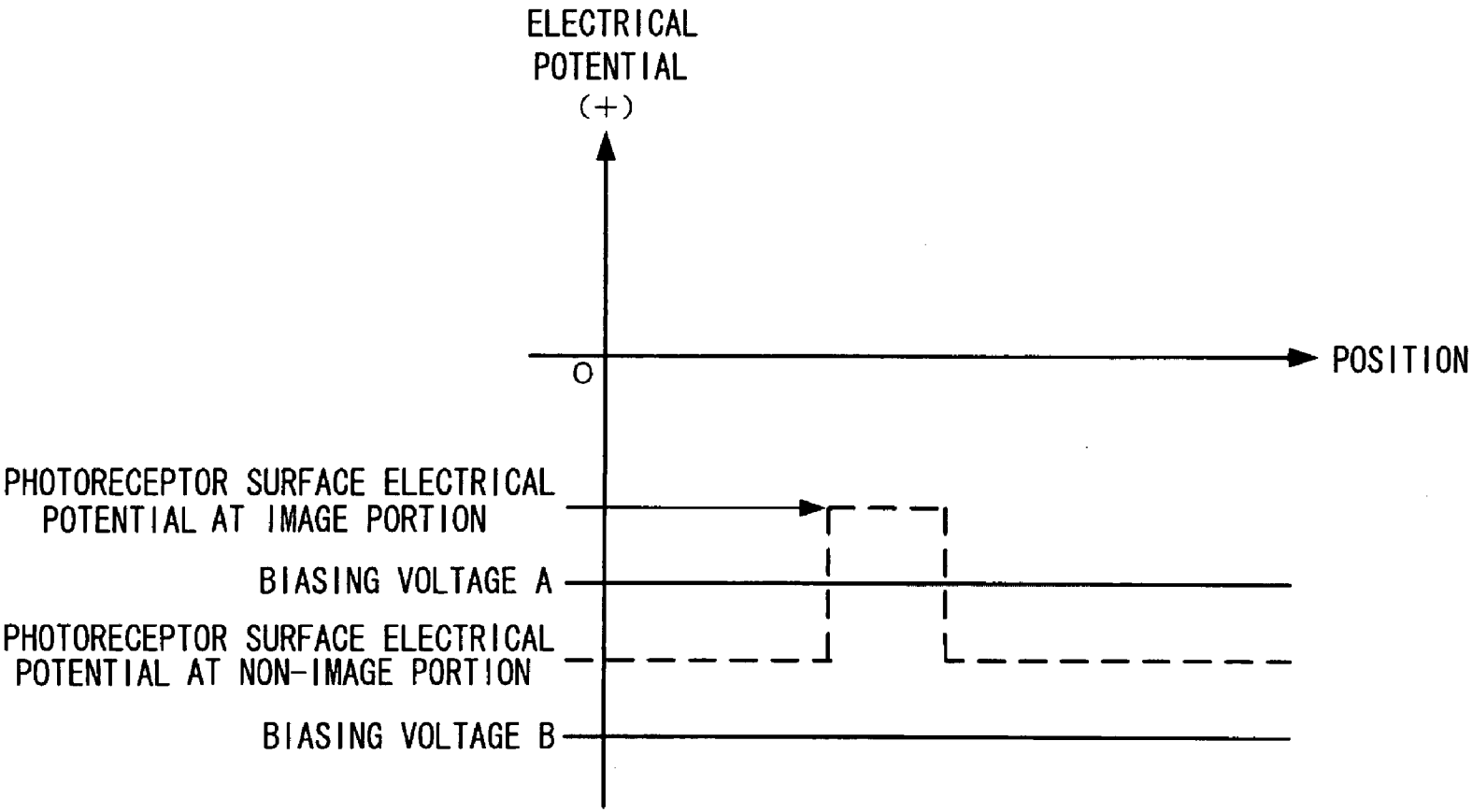
FIG. 8 is a graph showing a relationship between a biasing voltage A and a biasing voltage B.

The relationship between the above described biasing voltage A and biasing voltage B will now be explained, with reference to FIG. 8. FIG. 8 is a graph showing electrical potential on the vertical axis and position on the surface of the photoreceptor 10 on the horizontal axis. The biasing voltage A normally used during image forming is, as shown in FIG. 8, an electrical potential between the electrical potential of the surface of the photoreceptor 10 of the non-image portion and the electrical potential of the surface of the photoreceptor 10 of the image portion. The biasing voltage B is an electrical potential that is about the electrical potential of the surface of the photoreceptor 10 of the non-image portion, or an electrical potential with a greater absolute value. Namely, a biasing voltage is applied to the toner that adheres the toner to the photoreceptor 10.

By using the biasing voltage B as the electrical potential applied to the toner, the toner is adhered to the image portion and to the non-image portion. The reason for such a biasing voltage B is that when biasing voltage A is used it is not possible to discriminate between a ghost image due to external additive and a ghost image due to a factor other than due to external additive.

Figure 9:
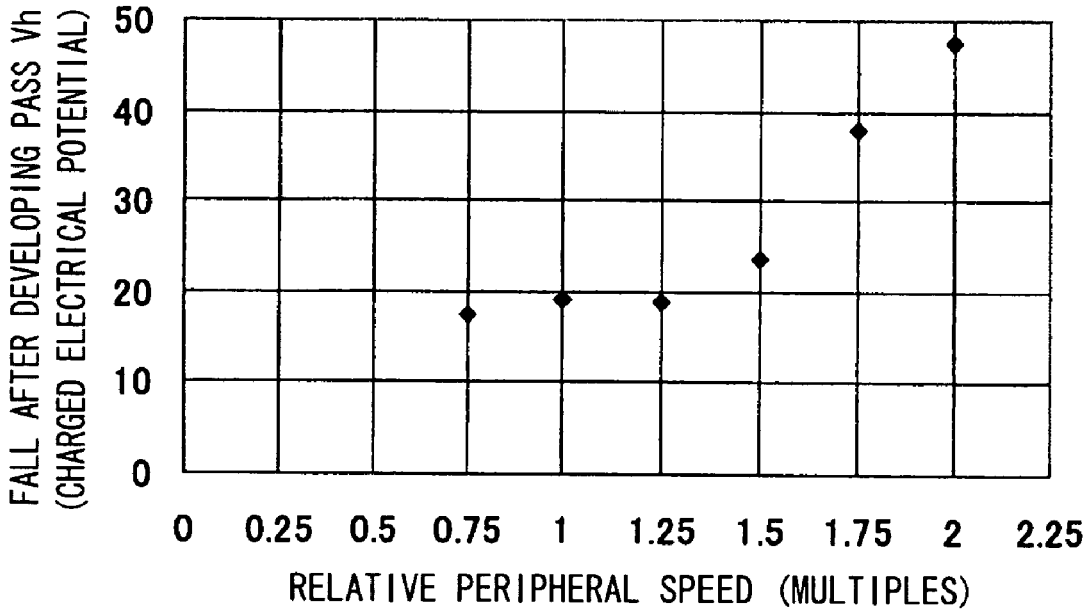
FIG. 9 is a graph showing a relationship between relative peripheral speed and generation of ghosting.

Explanation will now be given of the fact that ghost images are readily generated with conditions of a large relative peripheral speed, with reference to the graph shown in FIG. 9. The graph of FIG. 9 shows the difference in output of a provided ESV (surface electrical potential meter) between before and after developing on the vertical axis, a characteristic value roughly equivalent to how readily ghost images are generated, shown as ΔVh (the difference in photoreceptor surface charge electrical potential before and after passing development: the higher the value thereof the more readily ghost images are generated), and with relative peripheral speed shown on the horizontal axis. The relative peripheral speed shows the ratio of the rotational speed of the developing rotating body 25 to that of the photoreceptor 10.

This graph is a graph made by forming a latent image of a test image 30 times at a relative peripheral speed of 1.75 so as to form an adhered layer of external additive on the photoreceptor 10, then without forming a latent test image changing the relative peripheral speed while leaving Vcln=120, passing the surface of the photoreceptor 10 past the developing unit 14, and shows the ΔVh after passing the developing unit 14.

As shown in FIG. 9, as the relative peripheral speed increases conditions become more susceptible to ghost image generation. Consequently, the detection sensitivity may be raised by forming latent test images so as to rotate with various high sliding friction relative peripheral speeds, so as to produce on the photoreceptor 10 a surface that readily generates a ghost image by passage of external additive.

Since there is a high dependency on the amount of toner component adhered to the photoreceptor surface and to the surface roughness, conditions which do not readily generate ghost images may be found by trials using plural relative peripheral speeds.

Figure 7:
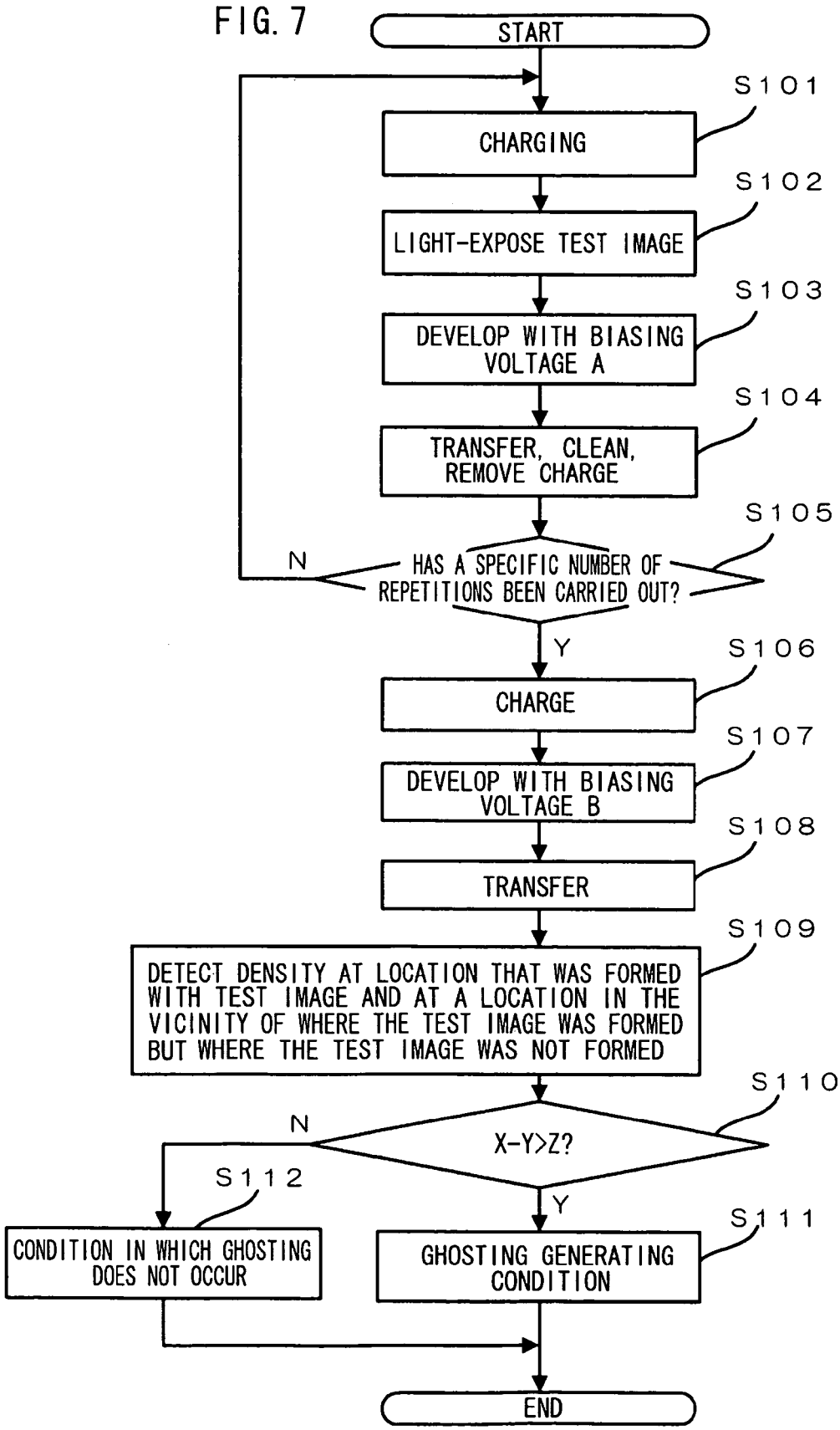
FIG. 7 is a flow chart showing the flow of image forming processing according to an exemplary embodiment.

When operating with various relative peripheral speeds in this manner, a step may be provided just after starting the routine in the flow chart explained for FIG. 7 for setting the relative peripheral speed.

Figure 10:
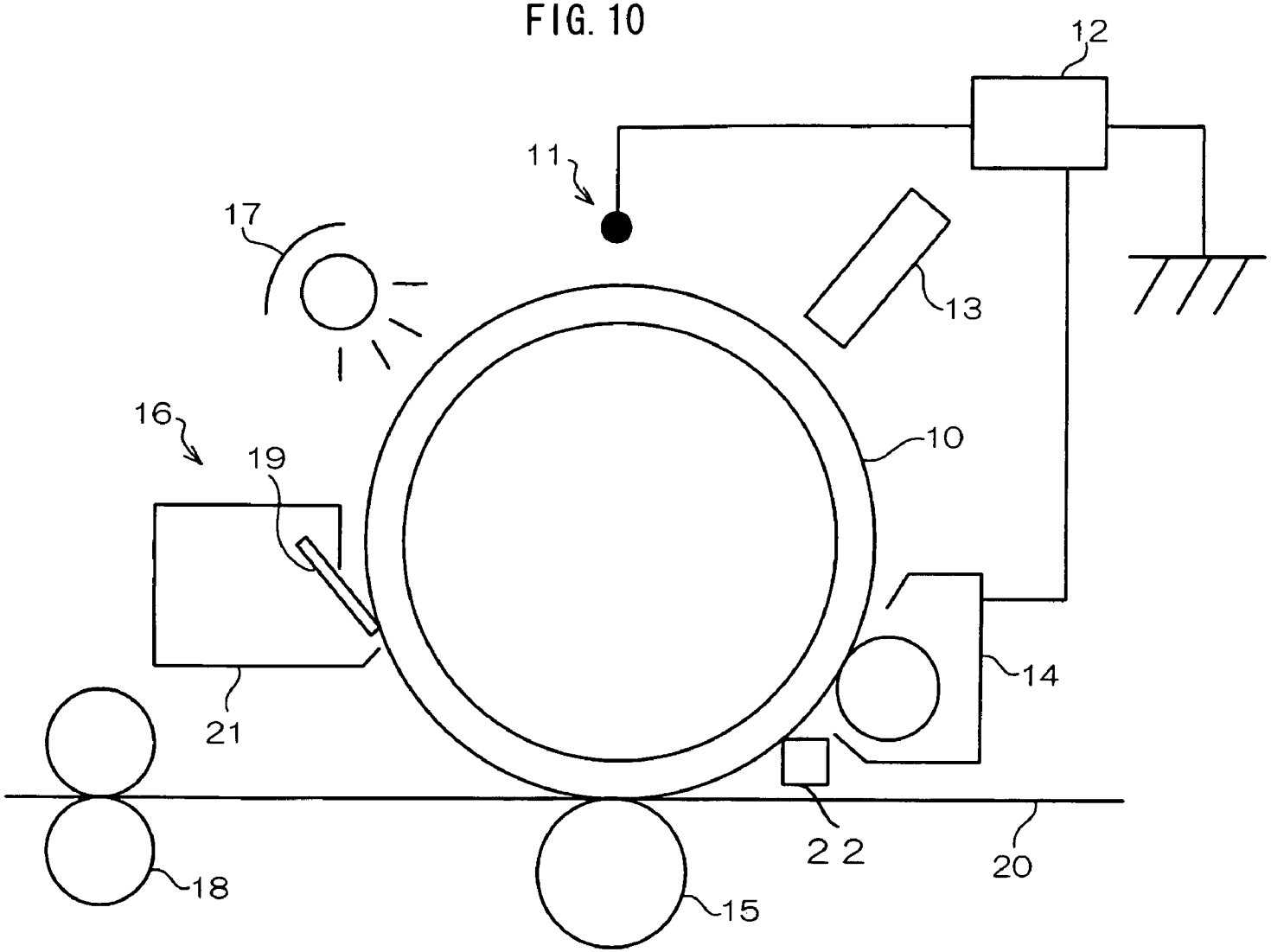
FIG. 10 is a schematic cross-section showing an example of an image forming apparatus.

In the exemplary embodiment explained above, the density detection unit 22 detects the density of toner transferred to the transfer body 20, however, as shown in FIG. 10, the density detection unit 22 may be provided below the developing unit 14, so as to detect the density of developed toner that has been developed on the photoreceptor 10.

In such cases the image forming apparatus includes: a photoreceptor (image carrier) 10; a charging unit (charging component) 11 that charges the photoreceptor 10 to a predetermined electrical potential; a light-exposing unit (exposing component) 13 that exposes the photoreceptor 10 that has been charged by the charging unit 11 with light to form a latent electrostatic image on the photoreceptor 10; a developing unit (developing component) 14 that develops the latent electrostatic image formed on the photoreceptor 10 by the light-exposing unit 13 using a developer, containing a colorant and an external additive, in a state applied with a biasing voltage; and a density detection unit (detection component) 22 that detects the density of a developer image transferred onto the photoreceptor 10 by the developing unit 14.

Also included in the image forming apparatus are: a transfer unit 15 that transfers the developer image that has been developed on the photoreceptor 10 by the developing unit 14 onto a transfer body 20; a static eliminator 17 that removes residual electrical potential on the surface of the photoreceptor 10; and a fixing unit 18 that fixes the toner image transferred onto the surface of the transfer body 20 by application of heat and/or pressure.

When the image forming apparatus is configured in such a manner, after controlling so as to develop a plural number of times developer images representing the same test image, control is performed such that light-exposure is not carried out with the light-exposing unit 13 and a biasing voltage is applied to developer by the developing unit 14 so as to adhere developer to the photoreceptor 10, thereby forming a developer image on the photoreceptor 10. Then detection is made as to whether or not a ghost image due to external additive is generated by detecting with the density detection unit 22 the density of the same location of the image carrier as that of the test image and the density at a location of the image carrier that is different to the same location, then comparing these two densities. Namely, at step 108 in the flow chart explained for FIG. 7, the density detection unit 22 detects the density X of toner at the position corresponding to an image portion on the surface of the photoreceptor 10, and the density Y of toner at a position corresponding to a non-image portion on the surface of the transfer body 20, so as to detect whether or not a ghost image due to external additive is generated.

Explanation will now be given of a configuration for detecting ghost image generation by electrical potential, using FIG. 11, this being different to the configuration for detecting ghost image generation by density explained in the above exemplary embodiment.

Figure 11:
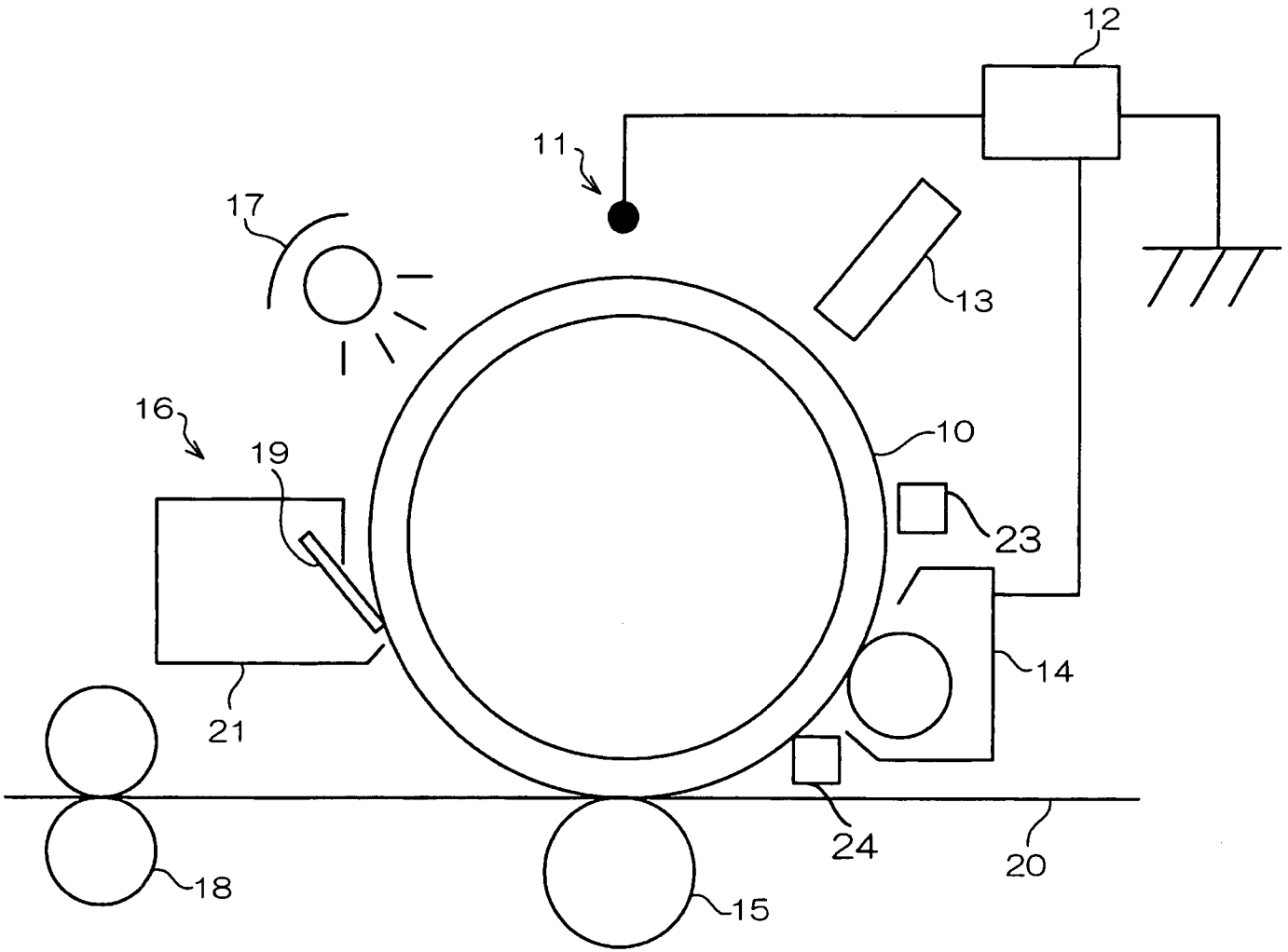
FIG. 11 is a schematic cross-section showing an example of an image forming apparatus.

The image forming apparatus shown in FIG. 11 includes: a photoreceptor 10; a charging unit 11 that charges the photoreceptor 10 to a predetermined electrical potential; a light-exposing unit 13 that exposes the photoreceptor 10 that has been charged by the charging unit 11 with light to form a latent electrostatic image on the photoreceptor 10; a first electrical potential detection unit 23 that detects the electrical potential of the photoreceptor 10 that has had an electrostatic latent image formed thereon by the light-exposing unit 13; a developing unit 14 that develops the latent electrostatic image formed on the photoreceptor 10 by the light-exposing unit 13 using a developer, containing a colorant and an external additive, in a state applied with a biasing voltage; a second electrical potential detection unit 24 that detects the electrical potential of the photoreceptor 10 after passing past the developing unit 14; a transfer unit 15 that transfers the developer image that has been developed on the photoreceptor 10 by the developing unit 14 onto a transfer body 20; and a cleaning unit 16 that removes any residual developer after the developer image has been transferred onto the transfer body 20 by the transfer unit 15.

Namely, the image forming apparatus shown in FIG. 11, is one that detects the electrical potential of the photoreceptor before developing and detects the electrical potential of the photoreceptor after developing. Generation of a ghost image can be detected in this configuration of image forming apparatus too.

Figure 12:
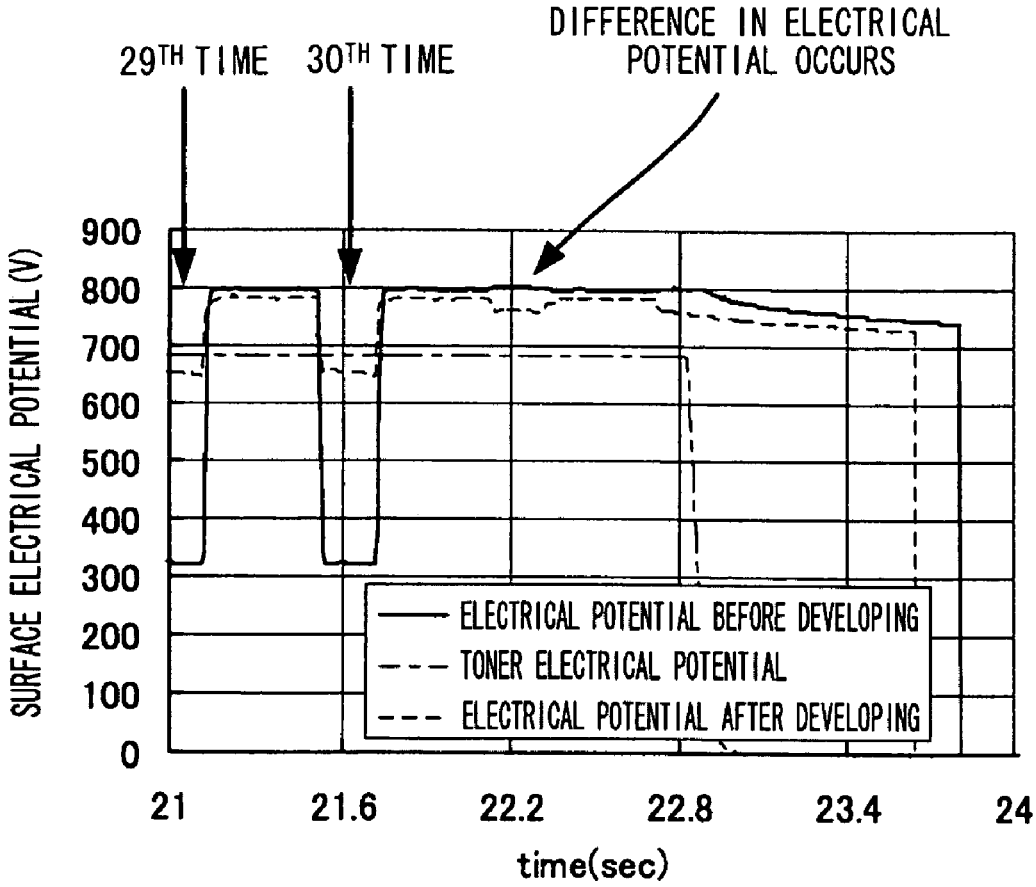
FIG. 12 is a graph showing a difference occurring between an electrical potential before developing and an electrical potential after developing.

Specific explanation will be given with reference to FIG. 12. FIG. 12 is a graph showing the passage of time on the horizontal axis and the electrical potential of the photoreceptor surface on the vertical axis. The graphs shows that, after 30 repetitions of forming a latent image of the test image, the photoreceptor surface electrical potential is set before developing such that a latent image is not formed. However, as shown by the arrow, after setting the photoreceptor surface electrical potential so as not to form a latent image, a difference occurs between the electrical potential of the photoreceptor 10 before developing and the electrical potential of the photoreceptor 10 after developing.

Figure 13:
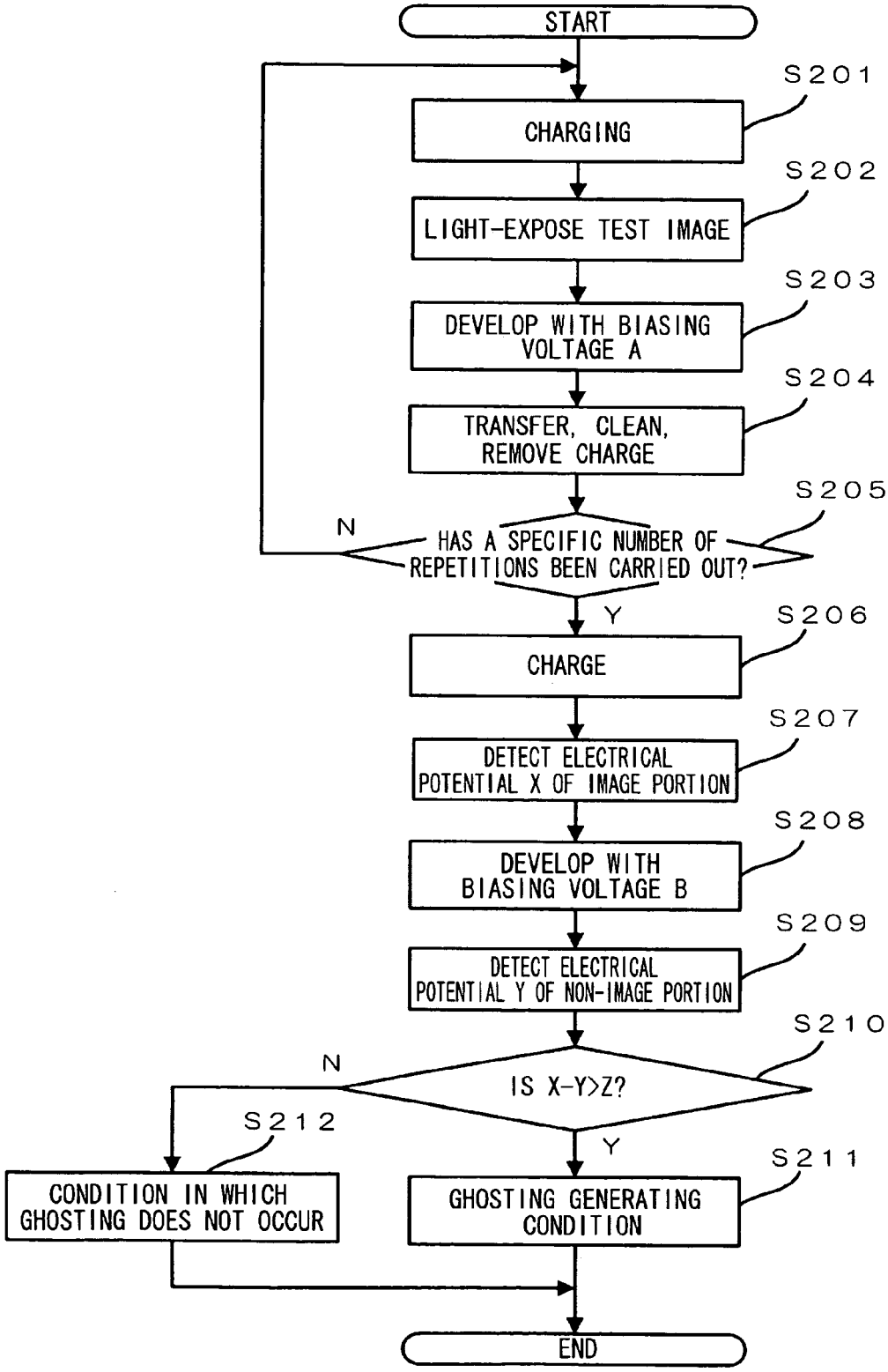
FIG. 13 is a flow chart showing a flow of image forming processing according to an exemplary embodiment.

The processing using electrical potentials to detect the generation of the above ghost image due to external additive will be explained with reference to the flow chart of FIG. 13. This processing is processing executed under control of the CPU 40.

First, at step 201, the charging unit 11 uniformly charges the surface of the photoreceptor 10. Next, at step 202, the light-exposing unit 13 performs light-exposure to form a latent test image. Next, at step 203, the developing unit 14 develops the test image with toner using the above described biasing voltage A. Then, at step 204, the transfer unit 15 transfers the toner image onto the surface of the transfer body 20. As described above, the blade 19 is used to remove residual toner however the passage thereunder of the external additive occurs, and the static eliminator 17 removes the residual electrical potential on the surface of the photoreceptor 10.

Determination is made at step 205 as to whether or not the above described process has been performed a predetermined number of times (a minimum of two times), and if this determination is negative then the process returns to step 201. The processing of above described step 201 to step 205 is processing to develop a developer a plural number of times an image representing the test image formed by the light-exposing unit 13 in the same location on the photoreceptor 10.

However, when the determination at step 205 is affirmative, then at step 206 the charging unit 11 uniformly charges the surface of the photoreceptor 10. Then at step 207, without forming a latent image, the electrical potential X of an image portion of the photoreceptor 10 is detected by the first electrical potential detection unit 23. At step 208 the developing unit 14 applies a biasing voltage B with absolute value smaller than the photoreceptor charged electrical potential (this may be the same as biasing voltage A).

The processing of step 206 to step 208 is processing to control such that while no light-exposure is performed by the light-exposing unit 13, a developer image is developed on the photoreceptor 10 by the developing unit 14 applying a biasing voltage to adhere developer to the photoreceptor 10, including the same location on the photoreceptor 10, and the photoreceptor 10 is developed with developer.

At the next step 209, the second electrical potential detection unit 24 detects the electrical potential Y of an image portion on the photoreceptor 10. A state of ghost image generation is detected at the next step 211 when determination is made at step 210 that the difference between the electrical potential X and the electrical potential Y is greater than a predetermined value Z. At step 212 a state in which a ghost image is not generated is detected when the determination is negative at step 210, and the processing is ended. Note that the above described Z is a value pre-determined on the basis of test results or the like.

In the configuration shown in FIG. 11 as well, as the relative peripheral speed increases conditions become more susceptible to ghost image generation. Consequently, the detection sensitivity may be raised by forming latent test images so as to rotate with various high sliding friction relative peripheral speeds, so as to produce the photoreceptor 10 a surface that readily generates a ghost image by passage of external additive.

Since there is a high dependency on the amount of toner component adhered to the photoreceptor surface and to the surface roughness, conditions which do not readily generate ghost images may be found by trials using plural relative peripheral speeds.

The processing of each of the flow charts explained above are only examples, and obviously the processing sequence may be changed, new steps added, and redundant steps removed, without departing from the scope of the present invention.

What is claimed is:

1. An image forming apparatus comprising:

an image carrier;

a charging component that charges the image carrier to a predetermined electrical potential;

an exposing component that exposes the image carrier charged by the charging component with light and forms an electrostatic latent image on the image carrier;

a developing component that develops the electrostatic latent image formed on the image carrier by the exposing component, using a developer in a state a biasing voltage is applied, the developer comprising a colorant and an external additive;

a transfer component that transfers the developer image developed on the image carrier by the developing component onto a transfer body;

a detecting component that detects a density of the developer image transferred onto the transfer body by the transfer component;

a removing component that removes residual developer on the image carrier after the developer image has been transferred onto the transfer body by the transfer component;

a first control component that controls the charging component, the exposing component, and the developing component such that a developer image representing a predetermined image is transferred onto the transfer body;

a second control component that, after the first control component has controlled so as to develop the developer image representing the predetermined image formed a plurality of times in the same location on the image carrier by the exposing component, controls such that without performing exposure with the exposing component, the developer image, developed on the image carrier by the developing component applying a biasing voltage to the developer so as to adhere the developer to the image carrier including to the same location on the image carrier, is transferred to the transfer body; and a ghost image generation detecting component that detects whether or not a ghost image is generated by, after control by the second control component, comparing the density detected by the detecting component at a position of the transfer body corresponding to the same location of the image carrier with a reference density.

2. The image forming apparatus of claim 1, wherein:

the image carrier is a rotating body of a circular cylindrical shape that rotates about an axis connecting the center of circles at the two ends of the circular cylinder;

the developing component rotates a developer-adhered developing rotational body about an axis substantially parallel to the axis of the image carrier for performing developing with sliding friction due to a specific rotational speed of the developing rotational body relative to the rotational speed of the image carrier; and the second control component controls the first control component such that the developing rotational body is rotated at various rotational speeds.

3. The image forming apparatus of claim 1, wherein the reference density is a density detected at a position of the image carrier different from that of the same location.

4. An image forming apparatus comprising:

an image carrier;

a charging component that charges the image carrier to a predetermined electrical potential;

an exposing component that exposes the image carrier charged by the charging component with light and forms an electrostatic latent image on the image carrier;

a developing component that develops the electrostatic latent image formed on the image carrier by the exposing component, using a developer in a state a biasing voltage is applied, the developer comprising a colorant and an external additive;

a detecting component that detects a density of the developer image developed on the image carrier by the developing component;

a first control component that controls the charging component, the exposing component, and the developing component so as to develop the developer image representing a predetermined image;

a second control component that, after the first control component has controlled so as to develop the developer image representing the predetermined image formed a plurality of times in the same location on the image carrier by the exposing component, controls such that without performing exposure with the exposing component, the developer image is developed with developer by applying to the developer a biasing voltage for adhering the developer onto the image carrier including to the same location of the image carrier; and a ghost image generation detecting component that detects whether or not a ghost image is generated by, after control by the second control component, comparing the density detected by the detecting component at the same location of the image carrier with a reference density.

5. The image forming apparatus of claim 4, wherein:

the image carrier is a rotating body of a circular cylindrical shape that rotates about an axis connecting the center of circles at the two ends of the circular cylinder;

the developing component develops rotates a developer-adhered developing rotational body about an axis substantially parallel to the axis of the image carrier for performing developing with sliding friction due to a specific rotational speed of the developing rotational body relative to the rotational speed of the image carrier; and the second control component controls the first control component such that the developing rotational body is rotated at various rotational speeds.

6. The image forming apparatus of claim 4, wherein the reference density is a density detected at a position of the image carrier different from that of the same location.

7. A storage medium readable by a computer, the storage medium storing a control program of instructions executable by the computer to perform a function for controlling:

an image carrier, a charging component that charges the image carrier to a predetermined electrical potential, an exposing component that exposes the image carrier charged by the charging component with light and forms an electrostatic latent image on the image carrier, a developing component that develops the electrostatic latent image formed on the image carrier by the exposing component, using a developer in a state a biasing voltage is applied, the developer comprising a colorant and an external additive, a transfer component that transfers the developer image developed on the image carrier by the developing component onto a transfer body, a detecting component that detects a density of the developer image transferred onto the transfer body by the transfer component, and a removing component that removes residual developer on the image carrier after the developer image has been transferred onto the transfer body by the transfer component, the function comprising:

(a) controlling the charging component, the exposing component, and the developing component such that a developer image representing a predetermined image is transferred onto the transfer body;

(b) controlling so as to develop the developer image representing the predetermined image formed a plurality of times in the same location on the image carrier by the exposing component;

(c) controlling such that without performing exposure with the exposing component, the developer image, developed on the image carrier by the developing component by applying a biasing voltage to the developer so as to adhere the developer to the image carrier including to the same location on the image carrier, is transferred by the transfer component; and (d) after (c), controlling so as to compare the density detected by the detecting component at a position of the transfer body corresponding to the same location of the image carrier with a reference density.

* * * * *